US007302734B2

(12) United States Patent
Nowak et al.

(10) Patent No.: US 7,302,734 B2
(45) Date of Patent: Dec. 4, 2007

(54) GROUND CLEANING MACHINE

(75) Inventors: Harald Nowak, Goltoft (DE); Carsten Protz, Gromnitz (DE)

(73) Assignee: Hako-Werke GmbH, Bad Oldesloe (DE)

( * ) Notice: Subject to any disclaimer, the term of this patent is extended or adjusted under 35 U.S.C. 154(b) by 518 days.

(21) Appl. No.: 10/854,354

(22) Filed: May 26, 2004

(65) Prior Publication Data

US 2004/0237247 A1 Dec. 2, 2004

(51) Int. Cl.
*A47L 11/00* (2006.01)

(52) U.S. Cl. ..... 15/413; 15/340.3; 15/78

(58) Field of Classification Search ..... None
See application file for complete search history.

(56) References Cited

U.S. PATENT DOCUMENTS 3,165,775 A 1/1965 Lutz
3,604,051 A * 9/1971 Wendel et al. ..... 15/340.4
4,290,820 A 9/1981 Swisher, Jr. et al.
4,335,482 A 6/1982 Jones
4,368,554 A 1/1983 Mealing et al.
4,555,825 A 12/1985 Van Raaij
5,137,108 A 8/1992 Knowlton et al.
6,052,865 A 4/2000 Schwarze et al.

FOREIGN PATENT DOCUMENTS

FR 2650030 1/1991
GB 2287418 A 9/1995

* cited by examiner

*Primary Examiner*—David Redding
(74) *Attorney, Agent, or Firm*—Wildman, Harrold, Allen & Dixon LLP

(57) ABSTRACT

A mobile floor or ground cleaning machine includes a hydraulic motor for propulsion and/or operating a cleaning brush. Airflow produced by a fan is directed through a housing located adjacent the cleaning brush for creating an area of low pressure adjacent the brush. The housing includes a filter system through which the airflow is directed. Under the influence of the airflow, the closed housing, which preferably is a unitary structure, directs dirt directly into a receptacle and directs dust through the filter system for subsequent deposit in the receptacle. The housing forms a reservoir for oil which drives the hydraulic motor, with the airflow within the housing serving to cool the oil.

12 Claims, 4 Drawing Sheets

GROUND CLEANING MACHINE

FIELD OF THE INVENTION

This invention relates generally to self-propelled machines for cleaning generally flat surfaces such as floors and the ground and is particularly directed to a ground or floor cleaning machine having a hydraulically driven rotating brush, an air mover for creating a partial vacuum, and the combination of a filter and a receptacle for intercepting and removing foreign objects, dirt and dust swept from the ground and displaced by a streaming airflow.

BACKGROUND OF THE INVENTION

Different kinds of such ground cleaning machines are known. Usually, these machines are powered by a combustion engine. Among other things, this engine powers the pump of a hydraulic motor by means of which the ground traversing process is carried out. The hydraulic motor, or a different type of motor, may be used to power the sweeping roller. However, it is also possible to power the sweeping roller with a combustion engine by means of a V-belt.

In order to operate the hydraulic motor, the ground cleaning machine requires a reservoir for the hydraulic oil. The machine further requires a cooling unit by means of which the heated hydraulic oil is cooled. The cooling unit may, for example, apply cooling air to the reservoir to cool the hydraulic oil. As a result, a relatively large space is required to accommodate the use of the hydraulic motor and associated components. In addition, manufacturing costs for the hydraulic oil reservoir, the oil cooling unit, and a cooling fan have to be taken into consideration.

OBJECTS AND SUMMARY OF THE INVENTION

It is one purpose of the present invention to develop a ground cleaning machine having considerably reduced size and manufacturing costs.

In order to accomplish this purpose, a ground cleaning machine in accordance with the present invention includes an air duct housing constructed of double walls. The space between these walls forms a reservoir for holding the hydraulic oil; that is, ideally, the space between the double walls of the air duct housing serves as the reservoir for the hydraulic oil.

Consequently, the ground cleaning machine of the present invention includes an air duct housing which directs air from a cooling fan and also serves as a reservoir for the hydraulic oil. Airflow through the air duct housing cools the oil, that is, the air duct housing forms a cooling unit for the hydraulic oil. The air that is used as cooling air for the hydraulic oil is the same air that is used to transport the dirt particles to a filtering system for removal.

Since the air duct housing also serves as the reservoir for the hydraulic oil, it is not necessary to provide the cleaning machine with a separate oil cooling unit, as is the case with conventional ground cleaning machines. Consequently, a separate reservoir for hydraulic oil is eliminated in the present invention. Rather, the air duct housing performs the functions of both an oil cooling unit as well as a reservoir for the hydraulic oil.

A bottom portion of the air duct housing is preferably provided with an inflow opening to receive the dirt-filled air. If, in such a construction, the filtering system is located above the inflow opening of the air duct housing, it is not necessary to provide a separate support frame for the filtering system, or the like. The air duct housing in the present invention also provides this function.

An especially compact construction results if the fan wheel is built into an opening in, or next to, a sidewall of the air duct housing, where if the fan wheel draws air through this opening from the side of the filtering system opposite to the inflow opening. For this purpose, the fan wheel may, for example, be located in a housing having an opening for air emission. This housing is located on a lateral portion of the air duct housing, with the opening located outside of the sidewall of the air duct housing in the present invention.

In order to increase the cooling effect on the hydraulic oil, the inside of the air duct housing which is exposed to the airflow may be provided with heat radiating ribs.

More specifically, the present invention is directed to a floor-cleaning machine that traverses the ground for the purpose of cleaning the ground. The machine has at least one hydraulic motor to which a reservoir is connected containing hydraulic oil. The machine further includes a rotating cleaning brush, or sweeping roller, which engages the ground during the process of cleaning. The ground cleaning machine also has a cooling fan which generates a partial vacuum in the dirt disposal area of the cleaning brush. The inventive ground cleaning machine further includes an air duct housing for directing airflow for transporting the dirt particles and cooling the hydraulic oil and a filtering system for the removal of dirt particles from the airflow.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
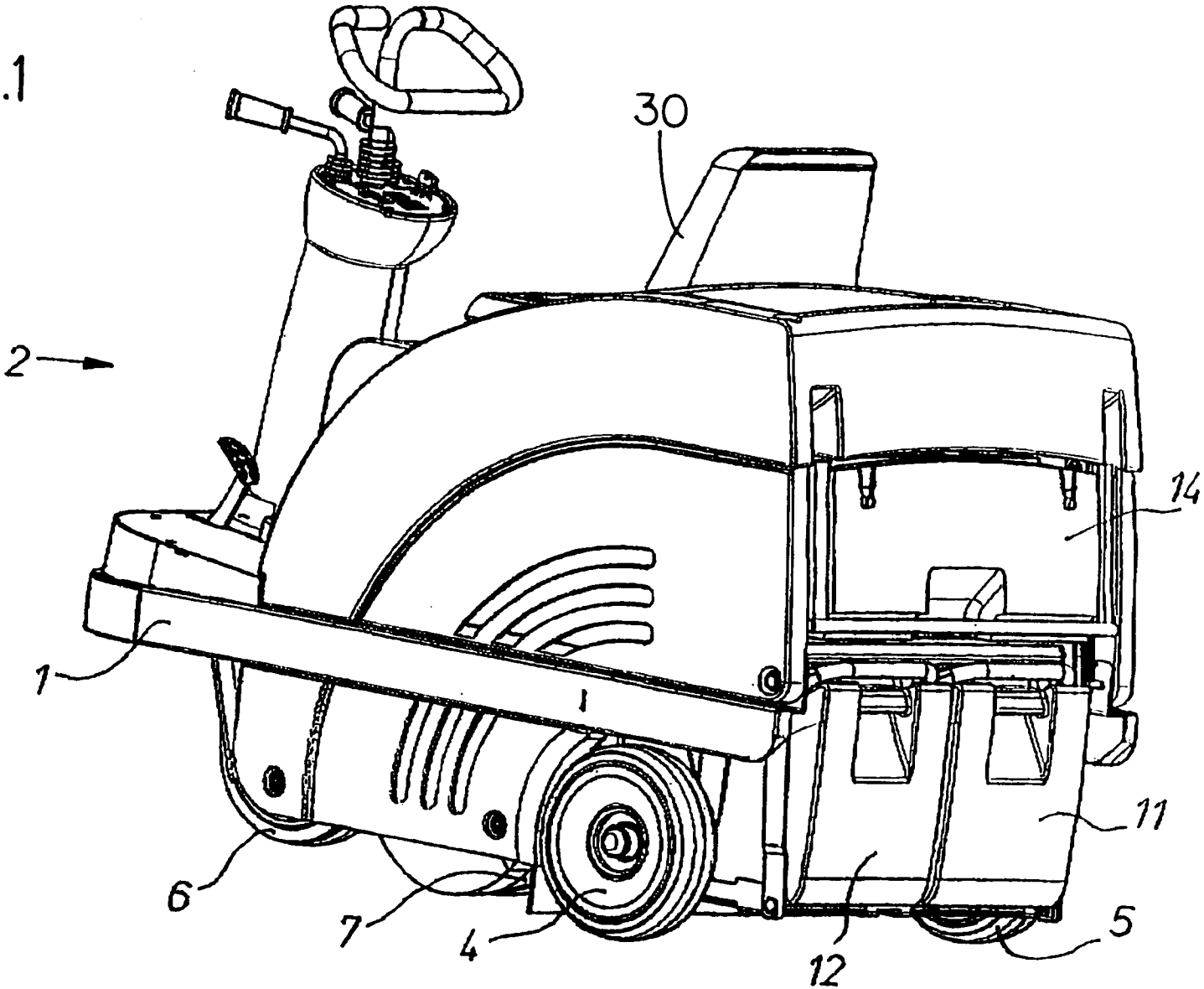
FIG. 1 is a perspective view of the ground cleaning machine of the present invention.
Figure 2:
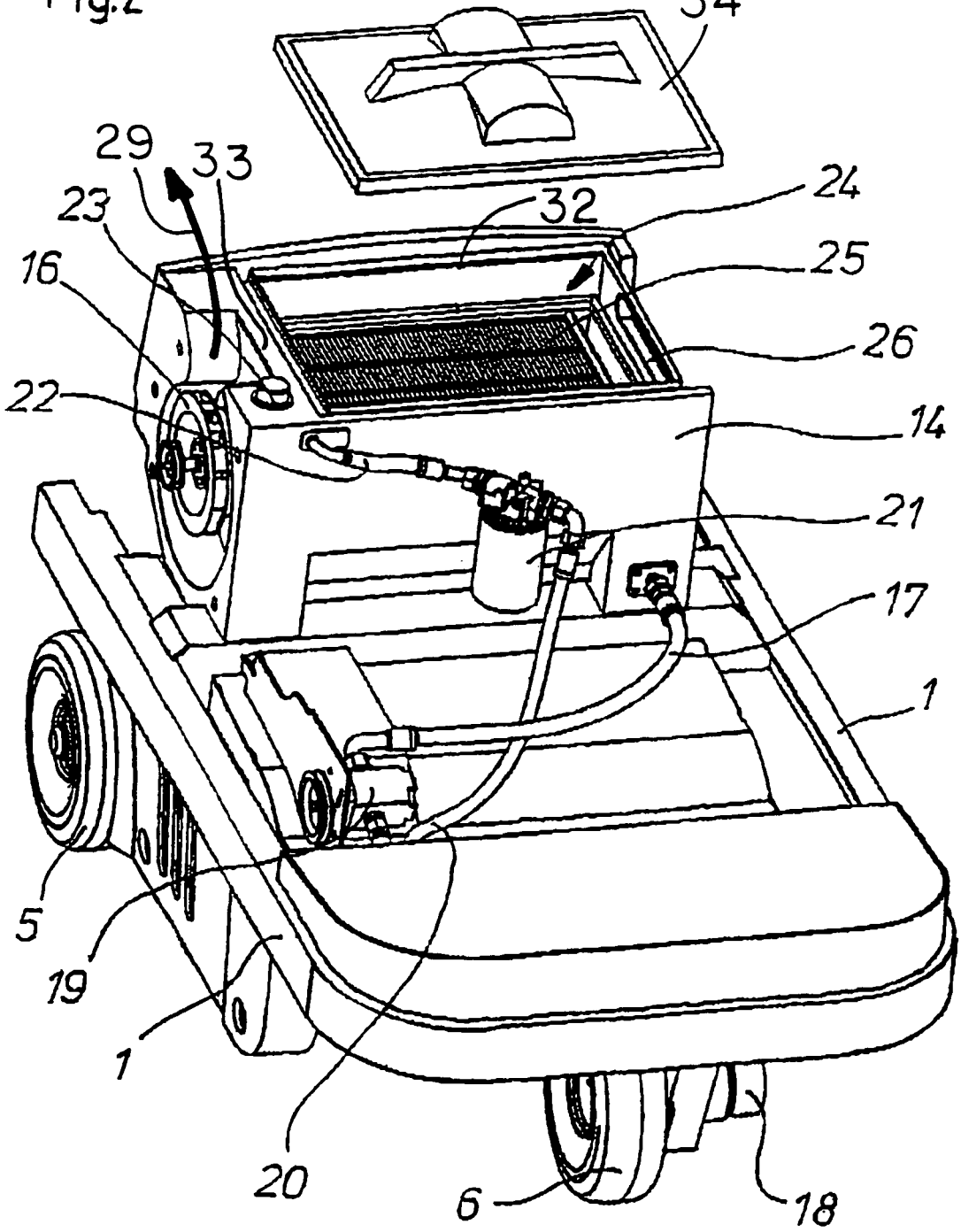
FIG. 2 is a partial perspective view of the chassis of the ground cleaning machine of FIG. 1.

Portions of the ground cleaning machine 2 of the present invention shown in the perspective view of FIG. 1 are conventional in design and operation. FIG. 2 is a partial perspective view of the chassis of the ground cleaning machine shown in FIG. 1, while FIG. 3 is a simplified longitudinal sectional view of the chassis portion of the ground cleaning machine shown in FIG. 2.

Ground cleaning machine 2 has a chassis 1 with two rear wheels 4 and 5 and a front wheel 6. On the chassis, provision is made for a driver's seat 30 as well as various control elements to operate the ground cleaning machine 2. Ground cleaning machine 2 has a rotating sweeping roller 7 which touches the ground during the process of cleaning. As shown in FIG. 3, sweeping roller 7 rotates counterclockwise in the direction of arrow 3 so that the dirt particles are thrown upward. As is usually the case, the dirt particles are then transported between a baffle plate 8 and the outer periphery of the sweeping roller 7 upward into a dirt routing duct 31. Dirt routing duct 31 is provided with passage openings 10 through which the dirt particles are forced by airflow under pressure. The dirt is directed into dirt receptacles 11 and 12. This process is described below in greater detail and is discussed in co-pending application Serial No. assigned to the assignee of the present application.

Figure 3:
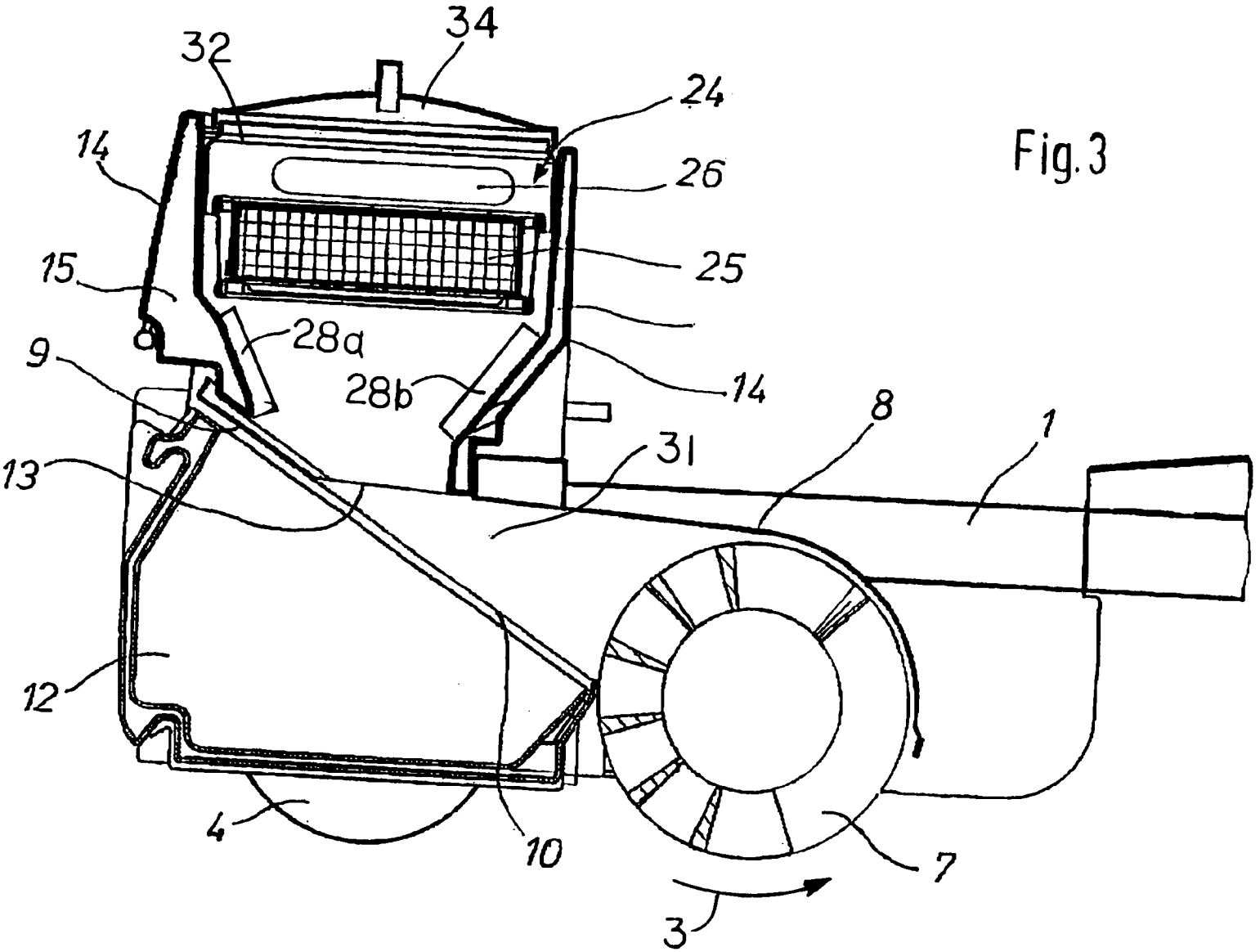
FIG. 3 is a simplified longitudinal sectional view of the chassis portion of the ground cleaning machine shown in FIG. 2.

As shown in FIG. 3, dirt routing duct 31 terminates at a duct opening 13, which is located between a baffle plate 9 and the open bottom end of an air duct housing 14. Within the air duct housing 14, there is a filtering system 24 disposed in a support frame 32, which may be removed by lifting upwardly. In a sidewall 33 of the air duct housing 14, there is a fan wheel 16 which is connected through an opening in the housing's sidewall 33 to the inside portion of the air duct housing 14 above the filtering system 24. Fan wheel 16 is located in a cut-out of sidewall 33 of the air duct housing 14. During operation, air duct housing 14 is covered with a removable plate 34. This provides an upwardly directed opening for air emission. Plate 34 may be attached with screws (not shown), which may be screwed into threaded holes (also not shown) located in sidewalls of the air duct housing 14, although it has been found that the suction created by the fan wheel 16 is sufficient to maintain the plate in position on the air duct housing. During operation, fan wheel 16 generates an area of reduced air pressure above a filter 25 disposed in the filter system 24. Consequently, as is usually the case in these types of cleaning machines, airflow moves through opening 13 and filtering system 25 from the dirt disposal area of the sweeping roller 7. This airflow then moves through the opening in the sidewall 33 of air duct housing 14 and through fan wheel 16 and escapes upward in the direction of arrow 29.

The airflow is dirt filled, and this dirt is deposited at the bottom side of the filtering system 24. If there is so much dirt collection in filtering system 24 that it results in an insufficient suction effect in the area of the sweeping roller 7, the filtering system may be cleaned by way of a vibration process. For this purpose, the operator of the machine opens an air flap 26 which is located in the support frame 32 of the filtering system 24. This results in reduced pressure at the bottom side of the filtering system 25 even though the fan wheel 16 continues to rotate. In these types of cleaning machines, this vibration process of the filtering system 25 is usually performed by means of a vibration device, which is not shown in the figures for simplicity. In this way, dirt deposits are removed from the filtering system 25 and the dirt falls from the air filter 25 downward through the passage openings 10 and into the dirt receptacles 11 and 12.

As can be seen in FIG. 3, air duct housing 14 has double walls, providing an interior space 15. This interior space 15 serves as an oil reservoir for the hydraulic oil which drives a hydraulic motor 18 in order to operate the front wheel 6. If necessary, the hydraulic oil may also be used to operate the sweeping roller 7, or the like.

The hydraulic oil is deposited in the oil reservoir formed of the interior space 15 within the air duct housing through an opening which is sealed with a screw cap 23. During operation, by way of a connecting tube 17, the oil is provided to an oil pump 19 which feeds the hydraulic motor 18. The oil passes from the oil pump 19 via another tube 20 through an oil filter 21 and via still another tube 22 back into the interior space 15 of the air duct housing 14, or into the hydraulic oil reservoir.

During operation of ground cleaning machine 2, a constant airflow moves toward the fan wheel 16 through the inner walls of the air duct housing 14. This results in an effective cooling process of the inner walls as well as the hydraulic oil which is in the interior space defining the reservoir 15 of the air duct housing 14. This cooling process may be enhanced by placing radiator ribs 28*a* and 28*b* along the inner walls of the air duct housing 14. Air duct housing 14 also thus serves as a reservoir and cooling unit for the hydraulic oil. Air duct housing 14 contains the holding frame 32 of the filtering system 24 including air filter 25.

Figure 4:
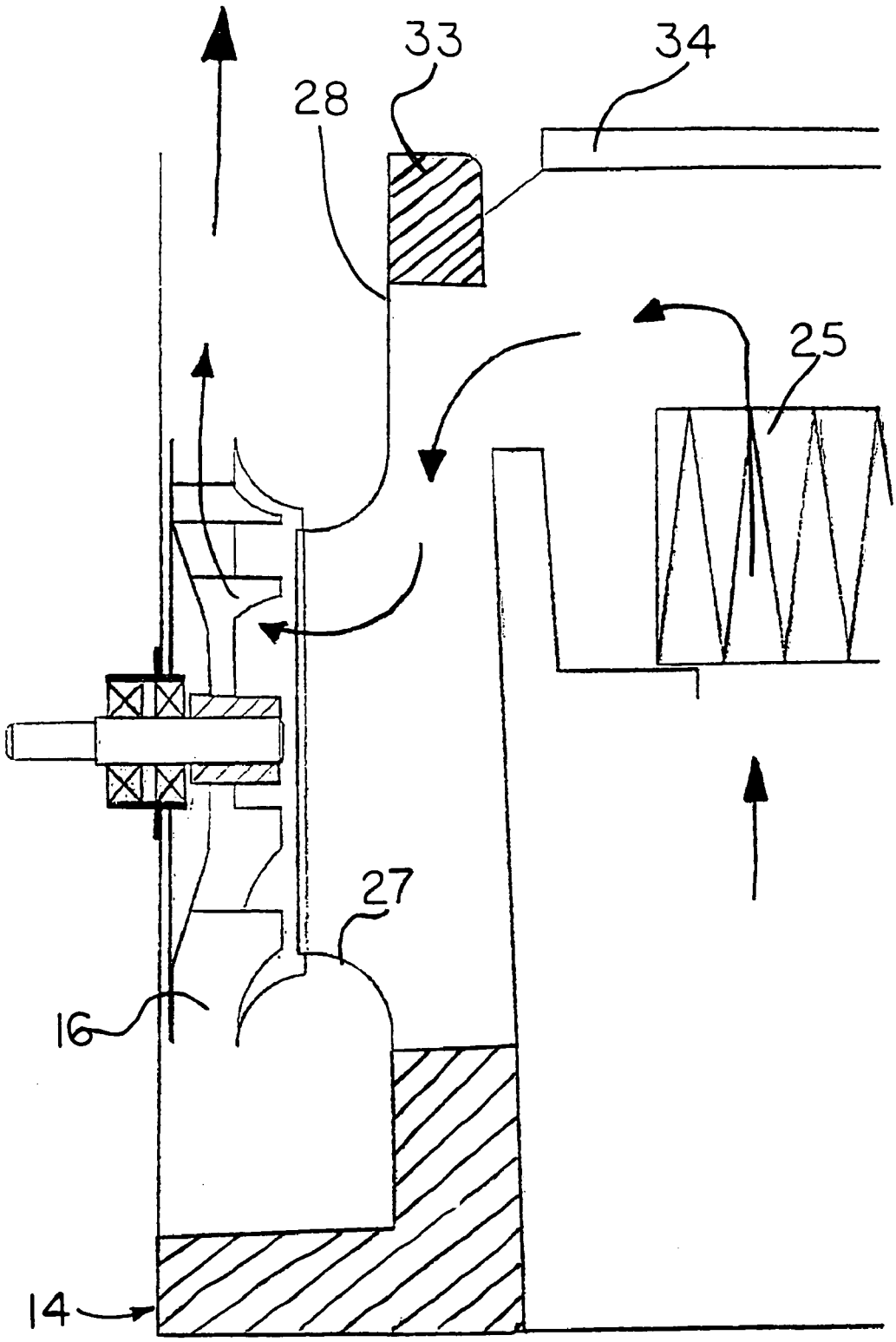
FIG. 4 is a simplified sectional view of a portion of the air duct housing in the present invention illustrating its attachment to a discharge fan and the flow of air through a filter and out of the air duct housing.

Referring to FIG. 4, there is shown a simplified sectional view of a portion of the air duct housing 14 illustrating its attachment to the discharge fan, or impeller, 16 and the flow of air through the filter 25 and out of the air duct housing. The series of arrows in FIG. 4 shows the path of air upward within the air duct housing 14 and through the air filter 25. The air then is drawn by the fan wheel 16 through an opening, or nozzle, 27 within the sidewall 33 of the air duct housing 14. The air is then discharged upwardly by the fan wheel 16 through a discharge passage 28 in a lateral, outer portion of the fan duct housing 14.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A self-propelled ground cleaning apparatus powered by a hydraulic motor, said apparatus comprising:

a rotating brush engaging the ground for removing debris from the ground;

a holding tank open at the top for receiving and storing the debris;

a fan for drawing air and debris from adjacent said rotating brush and over the open top of said holding tank and allowing the debris to drop into said holding tank;

a filter disposed above the open top of said holding tank; and a housing extending from adjacent the open top of said holding tank to said fan and enclosing said filter, wherein an inner portion of said housing forms an air duct for directing air through said filter and allowing dust in the air to be trapped in said filter for deposit through said open top into said holding tank by vibrating said filter when air is no longer drawn by said fan, said housing including a closed reservoir storing oil for the hydraulic motor, the oil in said reservoir is cooled by air drawn through said housing by said fan, wherein said housing is formed by an outer wall and includes an inner wall, said outer and inner walls forming said reservoir storing the oil for said hydraulic motor.

2. The apparatus of claim 1 wherein said housing is of unitary construction.

3. The apparatus of claim 1 wherein the inner wall of said housing is inwardly tapered in proceeding from said filter toward said holding tank.

4. The apparatus of claim 1 wherein the air is drawn over the inner wall of said housing by said fan.

5. The apparatus of claim 1 wherein said reservoir is disposed about a lateral portion of said housing.

6. The apparatus of claim 1 further comprising a holding frame disposed on the inner wall of said housing for engaging and supporting said filter above the open top of said holding tank.

7. The apparatus of claim 1 further comprising at least one cooling fin disposed on the inner wall of said housing and extending into the flow of air drawn through said housing for enhancing the cooling of the oil.

8. The apparatus of claim 1 further comprising a mounting arrangement disposed in a lateral wall of said housing for attaching said fan to said housing.

9. The apparatus of claim 8 further comprising a discharge passage in the lateral wall of said housing for allowing air to be discharged from said housing by said fan.

10. The apparatus of claim 9 further comprising an air channel disposed above said filter, wherein air is drawn by said fan through said air channel to allow dust and dirt to fall under the influence of gravity onto said filter for deposit into said holding tank.

11. The apparatus of claim 10 wherein said housing includes an upper aperture disposed above said air channel and said apparatus includes a removable cover disposed over said upper aperture.

12. Apparatus powered by a hydraulic motor for cleaning a surface, said apparatus comprising:

a rotating brush engaging the surface for removing dirt and debris therefrom;

a fan for producing an airflow;

a housing having an inner duct with a lower end, wherein said fan is disposed in an upper portion of said housing adjacent said inner duct for drawing air up through said inner duct and producing airflow within said housing and wherein the lower end of said inner duct is located adjacent said rotating brush and said airflow removes dirt and debris from adjacent said rotating brush;

an apertured receptacle disposed intermediate said rotating brush and the lower end of the inner duct of said housing for receiving and storing dirt and debris in the airflow from said rotating brush;

a filter disposed in said inner duct between the lower end of said inner duct and said fan for removing dust from the airflow within said inner duct; and a closed tank disposed in and forming a portion of said housing between said inner duct and an outer portion of said housing, wherein said tank holds oil for driving said hydraulic motor and wherein the airflow within said inner duct removes heat from said tank and cools the oil within said tank.

* * * * *